United States Patent [19]

Janssens et al.

[11] 4,220,710

[45] Sep. 2, 1980

[54] PHOTOSENSITIVE RECORDING MATERIALS

[75] Inventors: Wilhelmus Janssens, Aarschot; Frans C. Heugebaert, Kontich; Hendrik E. Kokelenberg, Merksem, all of Belgium

[73] Assignee: Agfa-Gevaert N.V., Mortsel, Belgium

[21] Appl. No.: 871,409

[22] Filed: Jan. 23, 1978

[30] Foreign Application Priority Data

Jan. 25, 1977 [GB] United Kingdom ..... 2990/77

[51] Int. Cl.[2] ..... G03C 5/24; G03C 1/00

[52] U.S. Cl. ..... 430/353; 430/495; 430/955

[58] Field of Search ..... 96/48 HD, 88, 114.1

[56] References Cited

U.S. PATENT DOCUMENTS

| | | | |
|---|---|---|---|
| 3,819,377 | 6/1974 | Klose et al. | 96/48 HD |
| 3,881,930 | 5/1975 | Schleigh | 96/88 |
| 4,076,530 | 2/1978 | Takeda et al. | 96/48 HD |
| 4,076,537 | 2/1978 | Tsuboi | 96/88 |

FOREIGN PATENT DOCUMENTS

| | | | |
|---|---|---|---|
| 2436132 | 2/1975 | Fed. Rep. of Germany | 96/48 HD |

*Primary Examiner*—Won H. Louie, Jr.

*Attorney, Agent, or Firm*—William J. Daniel

[57] ABSTRACT

A photosensitive recording material containing in admixture in a binder medium:

(1) as imaging substance an organo-tellurium compound containing directly linked to a tellurium atom halogen and at least one organic substituent comprising at least one carbonyl group, (2) a photoreductant which upon exposure to activating radiation in the presence of a hydrogen-donating compound reduces said organo-tellurium compound to liberate metallic tellurium and halogen acid, (3) a hydrogen-donating compound from which hydrogen can be abstracted by the photo-exposed photoreductant, and (4) an organic reducing agent precursor, from which by the action of an acid a compound capable of reducing said organo-tellurium compound can be set free.

13 Claims, 4 Drawing Figures

Fig. 1

PHOTOSENSITIVE RECORDING MATERIALS

Figure 1:
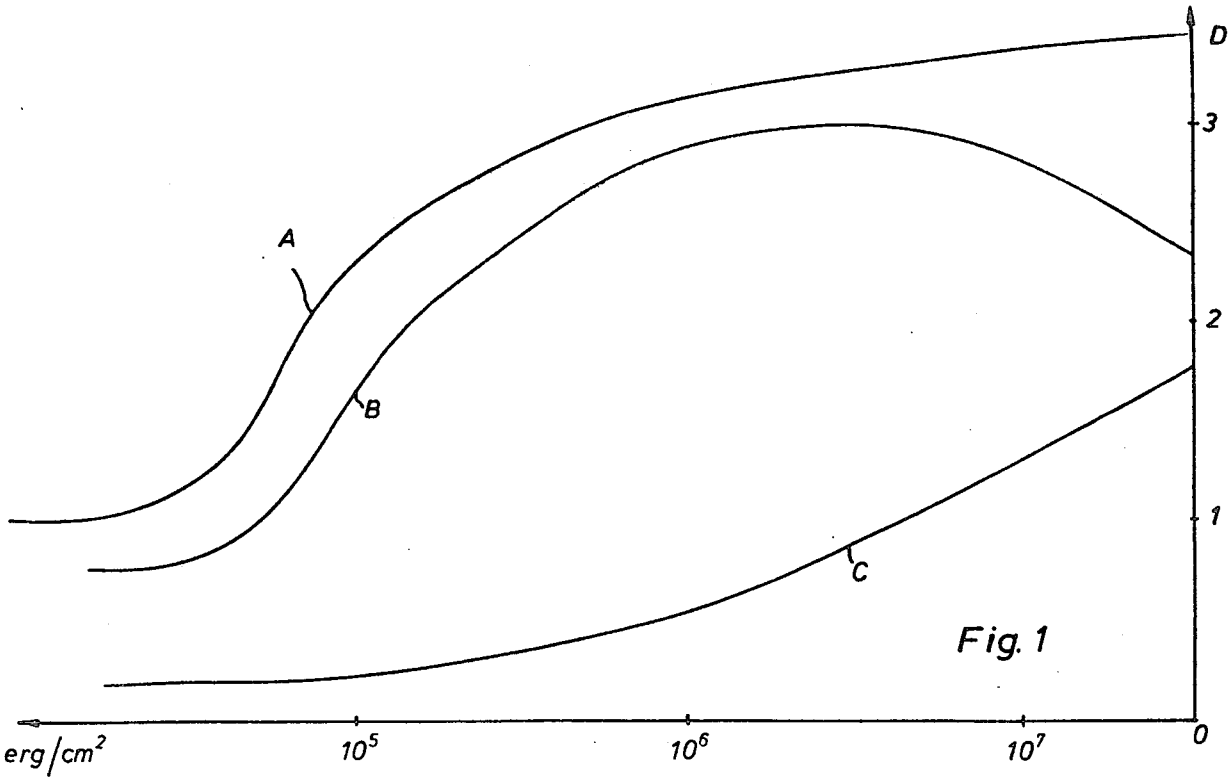

The present invention relates to photosensitive recording materials and a method of recording information by exposure of such materials to information-wise modulated activating electromagnetic radiation.

In the published German patent application (Dt-OS) No. 2,436,132 a method for producing a record of retrievable information has been described in which as imaging substance an organo-tellurium compound is used.

According to an embodiment of said process an imaging organo-tellurium compound, which contains halogen, preferably chlorine, linked directly to a tellurium atom and which contains at least one organic substituent comprising a carbonyl group, is reduced image-wise by means of a photo-exposed photoreductant e.g. a polynuclear quinone.

The following reaction scheme illustrates said process in which a tellurium metal image is formed:

$$PQ^{h\nu}\ {}^1PQ\ {}^3PQ$$

$${}^3PQ + 2RH \rightarrow PQ.H_2 + R{-}R$$

$$(R^1)_2.Te.Cl_2 + 2PQ.H_2 \rightarrow 2PQ + 2R^1H + Te + 2HCl$$

wherein:

PQ is a photoreductant e.g. phenanthrenequinone, $^1PQ$ is the first excited singlet of said quinone, $^3PQ$ is the triplet state of said quinone, RH is a hydrogen donor e.g. an organic hydroxy compound, $PQ.H_2$ is the photoreductant in reduced state, and $(R^1)_2.Te.Cl_2$ is a reducible organo-tellurium compound wherein $R^1$ is e.g. $(C_6H_5COCH_2)$.

A disadvantage associated with recording materials containing only these compounds is their rather low photosensitivity.

In accordance with the present invention a photosensitive recording material with improved sensitivity is provided, which contains in admixture in a binder medium:

(1) as imaging substance an organo-tellurium compound containing directly linked to the tellurium atom halogen and at least one organic substituent comprising at least one carbonyl group, (2) a photoreductant which upon exposure to activating radiation in the presence of a hydrogen-donating compound reduces said organo-tellurium compound to liberate metallic tellurium and halogen acid, (3) a hydrogen-donating compound from which hydrogen can be abstracted by the photo-exposed photoreductant, and (4) an organic reducing agent precursor, from which by the action of an acid, a compound capable of reducing said organo-tellurium compound can be set free; this precursor preferably is a precursor that passes the following assessment tests A and B.

ASSESSMENT TEST A

A 1% by weight solution of the compound (4) in an inert solvent e.g. methylene chloride is kept for 1 week at room temperature. Not more than 10% of the tested compound may be decomposed. Thin-layer chromatography is used as the method for separating the amount of compound left unaffected.

ASSESSMENT TEST B 1 millimole of compound (4) is dissolved in 2 millimoles of phenyl-1,2-ethanediol in a test tube of 50 ml. A reduced pressure of 20 mm Hg at 20° C. is applied thereto. Hydrogen chloride gas is allowed to enter the tube until a pressure of 1 atmosphere is reached again in the tube. Subsequently the closed tube is heated for 3 min at 170° C. on an oil-bath. After said treatment more than 50% of the tested compound should have decomposed. Thin-layer chromatography is used as in test A for separating the amount of compound left unaffected.

A class of organic reducing agent precursors, from which by the action of an acid a reducing agent for said organo-tellurium compound can be set free includes para- and orthodihydroxy aryl compounds of which at least one of the hydroxyl groups has been esterified and of which the remaining hydroxyl group (if any) may have been etherified. By acid-catalyzed hydrolysis the hydroxy group can be obtained in free state again so that the compound involved regains its reducing properties.

Another class of acid-sensitive organic reducing agent precursors is derived from pyrazolidin-3-one reductors, in which the active hydrogen atom in 2-position is temporarily blocked e.g. by reaction with an isocyanate or an acid halide.

Representatives of both classes of reducing agent precursors, which fulfill the requirements of the above-described assessment tests A and B, are listed in the following table 1.

Table 1

| Compound no. | Chemical structure | Melting point (MP) or boiling point (BP) °C. |
|---|---|---|
| 1 | 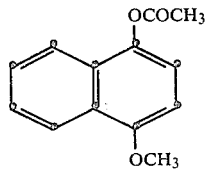  | BP 140–144 (0,05 mm Hg) |

Table 1-continued
| Compound no. | Chemical structure | Melting point (MP) or boiling point (BP) °C. |
|---|---|---|
| 2 | 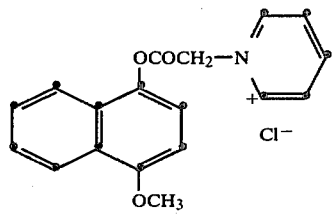 | MP about 200 |
| 3 | 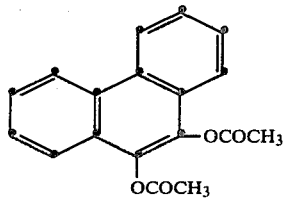 | MP about 200 |
| 4 | 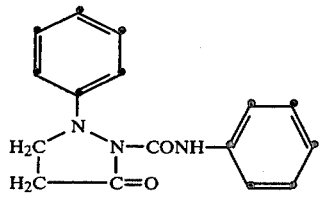 | MP 132 |
| 5 | 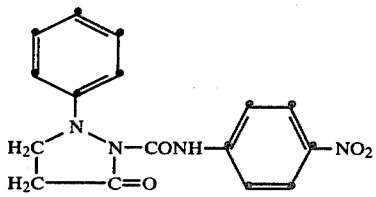 | MP 181 |
| 6 | 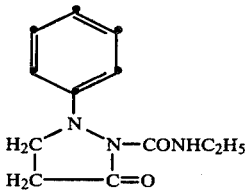 | MP 135 |
| 7 | 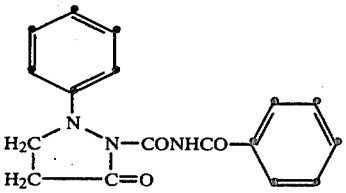 | MP 182 |
| 8 | 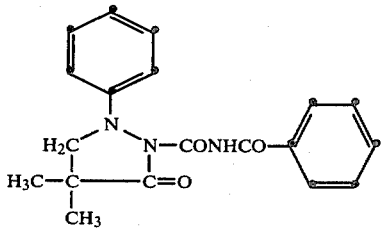 | MP 164 |

Table 1-continued

| Compound no. | Chemical structure | Melting point (MP) or boiling point (BP) °C. |
|---|---|---|
| 9 | 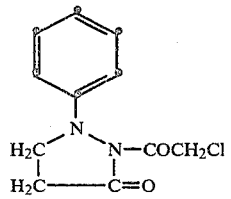 | MP 97 |

PREPARATION OF COMPOUND 1

1 Mole of 4-methoxynaphthol was dissolved in dioxan. While nitrogen gas was introduced into the reaction flask at reflux temperature, 1 mole of acetyl chloride was added.

Refluxing was continued. Subsequently, the solvent was evaporated and the residue distilled twice under reduced pressure. Boiling point of compound 1: 140°-144° C. at 0,5 mm Hg.

PREPARATION OF COMPOUND 2

1 Mole of the monochloroacetic acid ester of 1-(4-methoxy)-naphthol and 1.5 mole of pyridine were refluxed for 8 h in chloroform. Subsequently, the reaction mixture was cooled, ether was added, and the viscous oil left was washed several times with ether. The washed product was redissolved in chloroform and by slow evaporation of the chloroform allowed to crystallize. Melting point about 200° C.

PREPARATION OF COMPOUND 3

0.4 Mole of 9,10-phenanthrenequinone, 13.40 ml of acetic anhydride, 2 moles of sodium acetate, and 3.8 moles of zinc dust were mixed by stirring and subjected to boiling at reflux temperature for 2 h. Subsequently, the reaction mixture was cooled and the solids separated by suction.

The solids were boiled in 1 liter of acetic acid and then filtered to remove any zinc dust. The residue obtained from the filtrate by evaporation, was boiled in acetonitrile to yield compound 3 having a melting point of about 200° C.

PREPARATION OF COMPOUND 4

1 Mole of 1-phenyl-pyrazolidin-3-one and 1 mole of phenyl isocyanate were dissolved in 1.5 liter of toluene and refluxed for 8 h.

Subsequently, the solvent was evaporated under reduced pressure and the solid residue was recrystallized from ethanol, yielding compound 4 melting at 132° C.

PREPARATION OF COMPOUND 5

1 Mole of 1-phenyl-pyrazolidin-3-one and 1 mole of p-nitrophenyl isocyanate were dissolved in 3 liters of toluene and refluxed for 4 h. The reaction mixture was filtered while still hot. The crystalline product obtained on cooling had a melting point of 182° C.

PREPARATION OF COMPOUND 6

1 Mole of 1-phenyl-pyrazolidin-3-one and 1 mole of ethyl isocyanate were dissolved in 1.5 liter of toluene and refluxed for 8 h. After cooling the reaction mixture was diluted with hexane. The precipitate obtained was recrystallized from toluene/hexane. Melting point: 135° C.

PREPARATION OF COMPOUND 7

1 Mole of 1-phenyl-pyrazolidin-3-one and 1 mole of benzoyl isocyanate were subjected in 1 liter of toluene to boiling with reflux. The reaction mixture was cooled. The resulting solid compound 7 melted at 182° C.

PREPARATION OF COMPOUND 8

1 Mole of 1-phenyl-3,3'-dimethyl-pyrazolidin-3-one and 1 mole of benzoyl isocyanate were subjected in 1 liter of toluene to boiling with reflux. The reaction mixture was cooled. The resulting solid compound 8 melted at 163° C.

PREPARATION OF COMPOUND 9

1 Mole of chloroacetyl chloride was added to 1.2 mole of 1-phenyl-pyrazolidin-3-one and 1.2 mole of pyridine dissolved in 4 liters of benzene. After 2 h of boiling with reflux the reaction mixture was cooled and washed with water. The benzene layer was separated and the benzene removed by evaporation. The residue was dissolved in ethyl acetate and hexane was added to precipitate compound 9. Melting point: 94° C.

Another acid-sensitive reducing agent precursor suitable for use according to the present invention and containing an hydroxyl group masked as diether has the following structure:

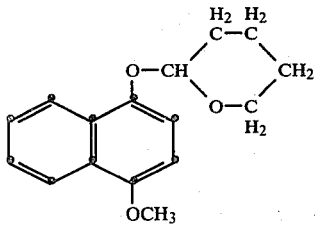

Said compound is prepared by addition of dihydropyran

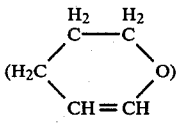

to 4-methoxy-α-naphthol as described in the published German Patent Application DT-OS No. 2,433,831.

The hydrogen-donating compound (3) is any conventional source of labile hydrogen as described e.g. in the U.S. Pat. No. 3,881,930, especially hydrogen-donating compounds, which have a hydrogen atom bonded to a carbon atom to which is also bonded the oxygen atom of a hydroxyl group and/or the trivalent nitrogen atom of an amine substituent.

Preferred hydrogen-donating compounds (3), from which hydrogen can be abstracted by said photo-exposed photoreductant correspond to the following general formula:

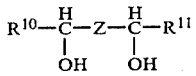

wherein:

each $R^{10}$ and $R^{11}$, which may be the same or different, represents hydrogen, a hydrocarbon group including a straight chain, branched chain, and cyclic hydrocarbon group, which groups may be substituted, e.g. an alkyl group, a hydroxyalkyl group, a cycloalkyl group or an aryl group, or an alkoxycarbonyl group e.g. a

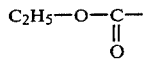

group,

Z represents a single bond, an ethynylene group

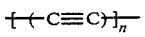

or the group

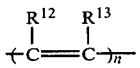

wherein n represents a whole number e.g. 1 and 2, and each of $R^{12}$ and $R^{13}$, which may be the same or different, represents hydrogen, or an alkyl group e.g. methyl or together form part of a carbocyclic or heterocyclic ring e.g. phenylene ring.

Specific examples of such hydrogen-donating compounds are listed in the following table 2.

Table 2

| No. of the compound | $R^{10}$ | Z | $R^{11}$ | Boiling point (BP) °C. or melting point (MP) | °C. |
|---|---|---|---|---|---|
| 1 | H | — | H | BP | 198 |
| 2 | 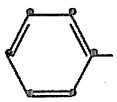 | — | H | MP | 67 |
| 3 | $H_3C$— | — | H | BP | 189 |
| 4 | $H_3C$ | — | —$CH_3$ | BP | 183 |
| 5 | H | —C≡C— | H | MP | 52–54 |
| 6 | H | 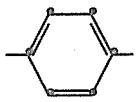 | H | MP | 112 |
| 7 | $HO(CH_2)_4$— | — | H | BP | 178/5 mm Hg |
| 8 | $C_2H_5OC$—<br>‖<br>O | — | $C_2H_5O$—C—<br>‖<br>O | BP | 280 |

The preparation of these compounds is known to those skilled in the art. A particularly suitable hydrogen-donating compound is phenyl-1,2-ethanediol (compound 2 of table 2).

Any compound that acquires reducing action with respect to said tellurium compound through photo-induced hydrogen abstraction from a hydrogen-donating compound (3) can be used as the photoreductant compound (2).

A survey of photoreductants is given in Research Disclosure October 1974 p. 14–17 No. 12617.

Photoreductants (2) preferred for use according to the present invention are aromatic diketones and especially 1,2-and 1,4-benzoquinones with at least one fused-on carbocyclic aromatic ring.

Examples of photoreductants are listed in the following table 3 together with their approximate spectral sensitivity range.

Table 3

| Photoreductant | Spectral sensitivity range (nm) |
|---|---|
| 9,10-phenanthrenequinone | 200–400–500 |
| | U.V. visible |
| 1,1'-dibenzoylferrocene | 40–600 |
| 1-phenyl-1,2-propanedione | 400–500 |
| 2-hydroxy-1,4-naphthoquinone | 400–500 |
| benzil | 400–450 |
| furil | 400–480 |
| diacetylferrocene | 400–450 |
| acetylferrocene/ 400–450 | |
| 1.4-bis(phenyl glycoal)-benzene | 400–500 |
| o-naphthoquinone | Up to about 560 |
| 4,5-pyrenequinone | Up to about 530 |
| 4.5.9.10-pyrenequinone | Up to about 6550 |

In the reduction of said organo-tellurium compounds 9,10-phenanthrenequinone and 2-t-butylanthraquinone are especially satisfactory.

The following are illustrative photoreductants that are sensitive in the range up to about 400 nm and, therefore, are useful only in the ultraviolet range: benzophenone; acetophenone; 1,5-diphenyl-1,3,5-pentanetrione; ninhydrin; 4,4'-dibromobenzophenone; 2-t-butylanthraquinone and 1,8-dichloroanthraquinone.

Reducible organo-tellurium compounds (1) that yield good results in the process of the present invention correspond to the following general formula:

$R_xTeCl_y$ wherein:

R represents an organic group, which is linked by a carbon atom to the tellurium atom and contains at least one carbonyl group, x is 1, 2 or 3, and $x+y=4$.

Such compounds as well as their preparation are described in the published German patent application (DT-OS) No. 2,436,132.

A preferred class of imaging agents are organo-tellurium compounds corresponding to the following general formula:

$(Ar—CO—CH_2)_2TeCl_2$ wherein:

Ar stands for an aromatic group including a substituted aromatic group e.g. phenyl, methoxyphenyl, tolyl or naphthyl. Bis(phenacyl)tellurium dichloride is a preferred imaging agent for use according to the present invention in combination with a photoreductant, a hydrogen-donor and at least one of said acid-sensitive reducing agent precursors.

The photosensitive recording materials according to the present invention contain the photoreductant, a tellurium compound, an H-donor and an acid-sensitive reducing agent precursor in admixture in a binder medium.

Particularly suitable binders for use in recording materials according to the present invention are organic polymeric materials.

Illustrative thereof are cyano-ethylated starches, celluloses and amyloses having a degree of substitution of cyano-ethylation of at least 2; polyvinylbenzophenone; polyvinylidene chloride; polyethylene terephthalate; cellulose esters and ethers such as cellulose acetate, cellulose propionate, cellulose butyrate, methylcellulose, ethylcellulose, hydroxypropylcellulose, polyvinylcarbazole, polyvinyl chloride; polyvinyl methyl ketone, polyvinyl alcohol, polyvinylpyrrolidone, polyvinyl methyl ether, polyacrylic and polymethacrylic alkyl esters such as polymethyl methacrylate and polyethyl methacrylate; copolymer of polyvinyl methyl ether and maleic anhydride; various grades of polyvinyl formal resins such as so-called 12/85, 6/95 E, 15/95 S, 15/95 E, B-79, B-98, and the like, sold under the trademark "FORMVAR" —of Monsanto Company, St. Louis, Mo., USA.

Of special utility is polyvinyl formal 15/95 E, which is a white, free-flowing powder having a molecular weight in the range of 24,000–40,000 and a formal content expressed as % polyvinyl formal of approximately 82%, possessing high thermal stability, excellent mechanical durability, and resistance to such materials as aliphatic hydrocarbons, and mineral, animal and vegetable oils.

A dry photographic coating containing the above-mentioned ingredients can be formed by dissolving the binding agent or mixture of binding agents in a suitable inert solvent, which acts as dispersing or dissolving medium for the other ingredients and which is removed from the coating composition by evaporation so that a solid photographic recording layer on a properly chosen support is left. The supports may be of any kind encountered in silver halide photographic materials, e.g. paper and resin film.

The photoreductant is used in the recording material in an amount which is preferably at least equimolar with respect to the organo-tellurium compound. The coverage of the organo-tellurium compound is preferably in the range of 1 to 10 g per sq.m. The amount of hydrogen-donating compound is preferably at least 50% by weight with respect to the organo-tellurium compound.

The amount of acid-sensitive reducing agent precursor is not critical. Large improvements in sensitivity are obtained with amounts between 50 to 100% by weight with respect to the organo-tellurium compound.

The present invention includes a recording method in which the above defined recording material is used. This method includes the steps of information-wise exposing said material to activating electromagnetic radiation to which the photoreductant is sensitive and overall heating to develop a tellurium image in the photo-exposed parts of the material.

An information-wise ultraviolet exposure is normally used in combination with an aromatic diketone as photoreductant.

The heat-development preferably proceeds in the temperature range of 80° C. to 200° C. and in general lasts approximately 30 s to 300 s depending on the temperature.

The heat required to produce the metal image can be supplied in various ways. So, the recording material can be developed by heat transport from hot bodies e.g. plates or rollers or by contact with a warm gas stream e.g. hot air. Furthermore, the metal image can be formed by means of infrared radiation.

The following examples illustrate the present invention without, however, limiting it thereto. All percentages or ratios are by weight, unless otherwise indicated.

EXAMPLE 1

Control material C.

2.4 g of 2-t-butylanthraquinone, 3.8 g of 1-phenyl-1,2-ethanediol and 1.5 g of bis(phenacyl)-tellurium dichloride were dissolved in 50 ml of methylene chloride.

The solution obtained was mixed with 50 g of a 25% solution in methyl ethyl ketone of VINYLITE VAGH (trade name of Union Carbide and Carbon, New York, N.Y., USA, for a copoly(vinyl chloride/vinyl acetate/vinyl alcohol) (91/3/6)) and 1 ml of 2% of silicone oil in methylene chloride as coating aid.

The resulting coating composition was applied by dipcoating to a polyethylene terephthalate film support at a coverage of 2 g per sq.m of said organo-tellurium compound.

The coating was dried with ventilation first for 4 h at 30° C. and thereupon for 18 h at 45° C.

The obtained photosensitive recording material C was exposed for 100 s through a step wedge with constant 0.3 in the "SPEKTRAPROOF" (trade name) exposure apparatus of Siegfried Theimer GmbH 6481 Obersatzbach W. Germany equipped with a 2000 W lamp emitting with a maximum at about 350 nm.

The exposed material was developed by overall heating for 1 min at 160° C.

Recording material A according to the present invention.

The preparation of recording material A was the same as described for the control material C except for the additional use of 1.4 g of the acid-sensitive reducing agent precursor compound 7 of Table 1 in the coating composition.

Drying, exposure and heating of material A proceeded also as described for the control material C.

In the accompanying FIG. 1 the curves of density (D) versus photon exposure energy per sq.cm (erg/sq.cm) of the wedge images obtained on the control material C (curve C) and on the material A (curve A) are given.

From these curves is concluded that material A is more than 100 times as sensitive as the control material C.

EXAMPLE 2

Recording material B according to the present invention.

2.7 g of 2-t-butylanthraquinone, 3.8 g of 1-phenyl-1,2-ethanediol, and 1.5 g of bis(phenacyl)tellurium dichloride were dissolved in 40 ml of methylene chloride.

The obtained solution was mixed with 60 g of a 12.5% solution of VINYLITE VAGH (trade name) in a mixture of dichloromethane and dichloroethylene 50/50 by volume and 1 ml of a 2% solution of silicone oil in methylene chloride.

To said mixture 1.4 g of acid-sensitive reducing agent precursor compound 8 of Table 1 was added and the coating solution was applied to a polyethylene terephthalate support at a coverage of 1.9 per sq.m of said organo-tellurium compound.

Drying, exposure and heating of the obtained recording material B proceeded as described for control material C of Example 1.

The obtained density (D) versus erg/sq.cm curve of material B is presented in FIG. 1 as curve B. The sensitivity of material B is markedly higher than that of the control material C.

EXAMPLE 3

Recording material D according to the present invention.

1.7 g of 2-t-butylanthraquinone, 0.7 g of phenanthrenequinone, 3 g of 1-phenyl-1,2-ethanediol and 1.5 g of bis(phenacyl) tellurium dichloride were dissolved in 50 ml of methylene chloride.

The obtained solution was mixed with 33 g of a 25% solution of VINYLITE VAGH (trade name) in methyl ethyl ketone and 1 ml of 2% of silicone oil in methylene chloride.

To said mixture 1.6 g of acid-sensitive reducing agent precursor compound 9 of Table 1 was added and the coating solution was applied to a polyethylene terephthalate support at a coverage of 1.9 g per sq.m of said organo-tellurium compound.

The drying and exposure of the material D proceeded as described for material C in Example 1.

The development was carried out by heating the material D at 170° C. for 5 min.

Figure 2:
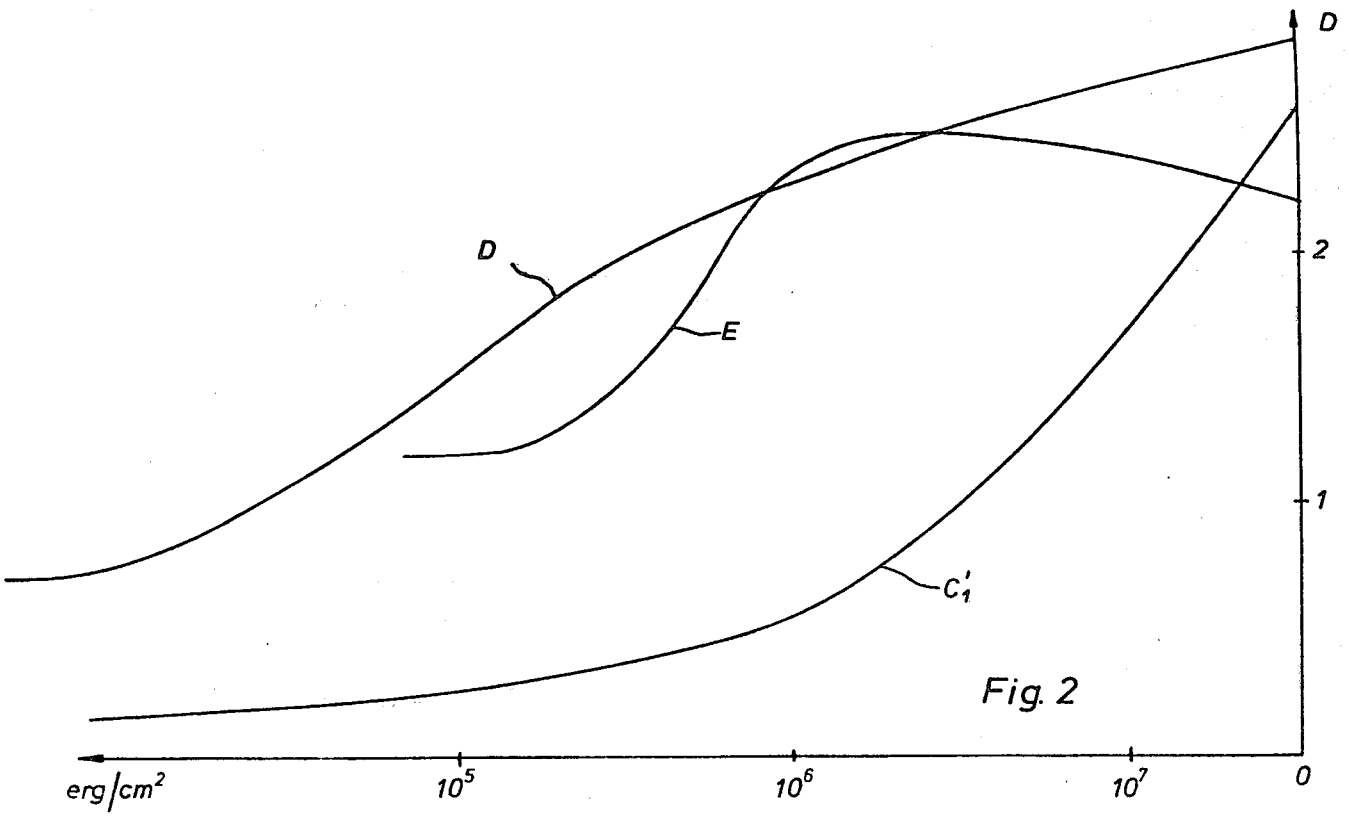

The obtained density (D) versus erg/sq.cm curve of material D is presented in FIG. 2 as curve D.

EXAMPLE 4

Recording material E according to the present invention.

The preparation of recording material E proceeded as described for material D except for the use of 2.2 g of acid-sensitive reducing agent precursor compound 2 of Table 1 instead of 1.6 g of said compound 9.

Coating was effected at 2 g per sq.m of said organo-tellurium compound.

Drying, exposure and development proceeded as described in Example 3.

The obtained density (D) versus erg/sq.cm curve of material E is presented in FIG. 2 as curve E.

EXAMPLE 5

Recording material F according to the present invention.

The preparation of recording material F proceeded as for material D except for the use of 4 g of acid-sensitive reducing agent precursor compound 3 of Table 1 instead of 1.6 g of said compound 9.

The coating was effected at 2 g per sq.m of said organo-tellurium compound.

The drying and exposure proceeded as described in Example 3. The development proceeded by overall heating the exposed material F at 190° C. for 5 min.

Figure 3:
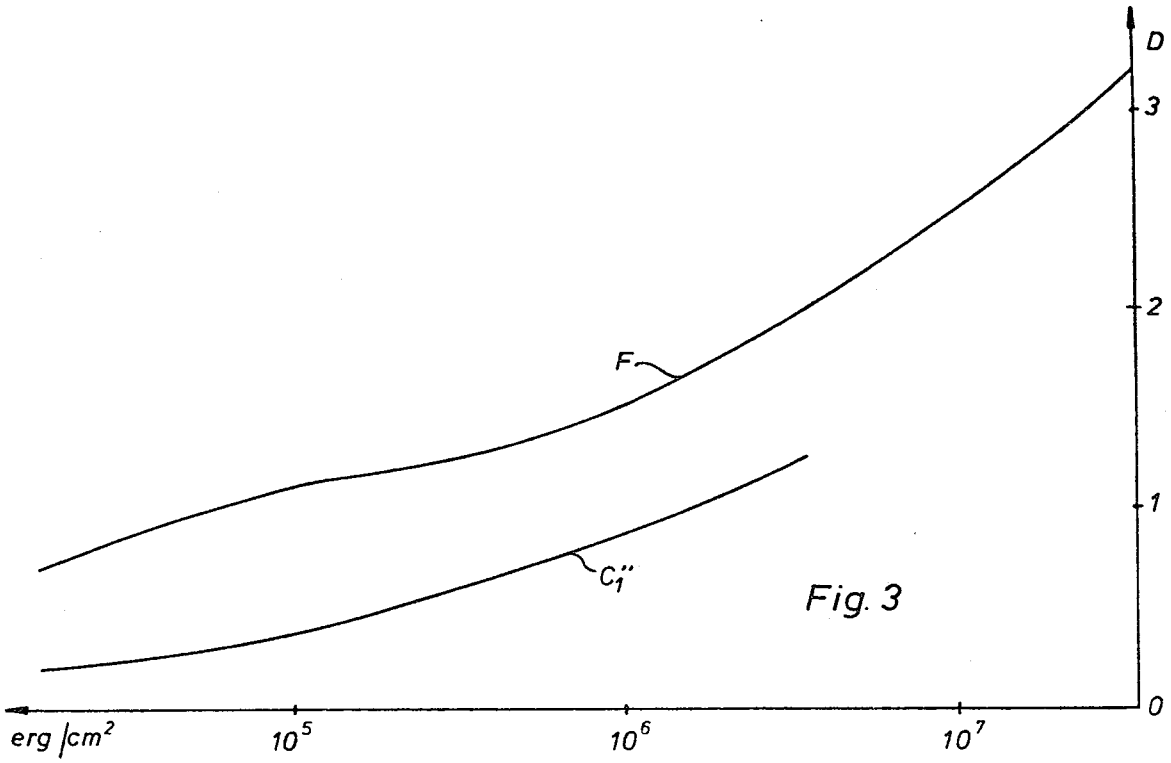

The obtained density (D) versus erg/sq.cm curve of material F is presented in FIG. 3 as curve F.

EXAMPLE 6

Control material $C_1$

The preparation of the control material $C_1$ was the same as that described for material D except for the absence of acid-sensitive reducing agent precursor.

Coating was effected at a coverage of 1.9 g per sq.m of organo-tellurium compound.

Drying and exposure proceeded as described in Example 1. Strip $C_1'$ was heat developed at 170° C. for 5 min, strip $C_1''$ was heat developed at 190° C. for 5 min and strip $C_1'''$ was heat developed at 160° C. for 5 min.

Figure 4:
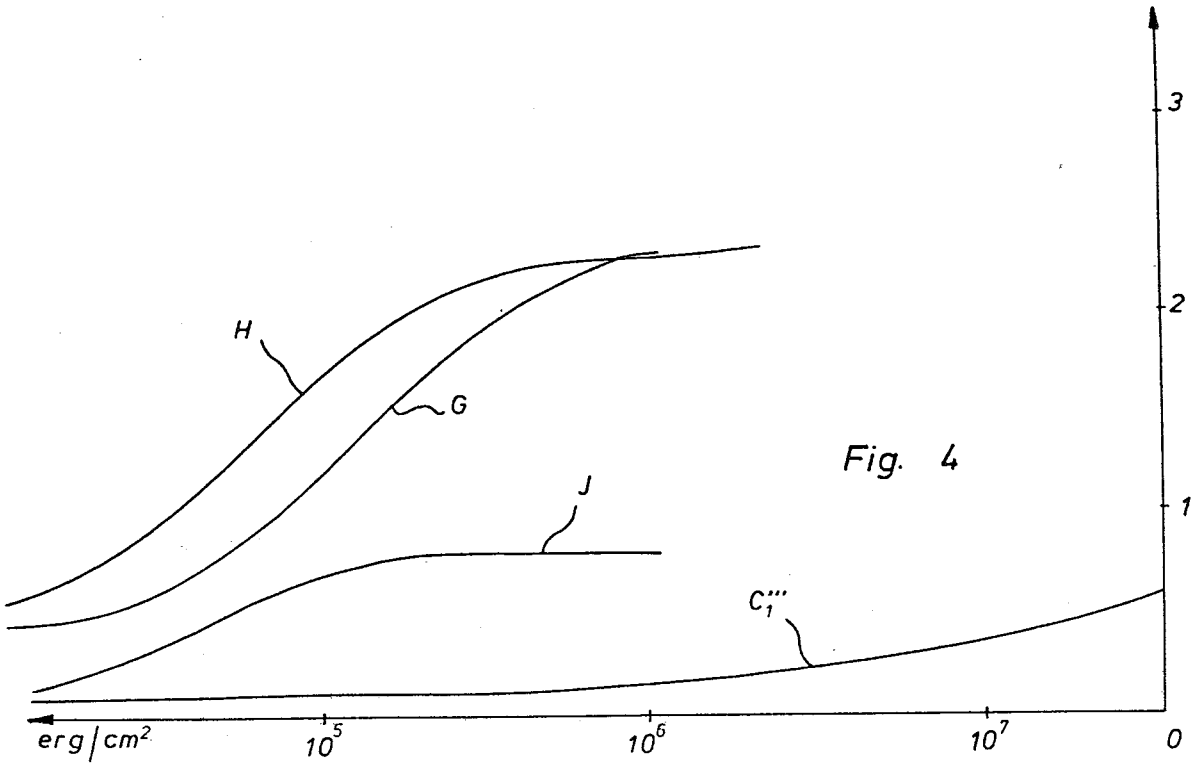

The curve of density (D) versus photon exposure energy per sq.cm (erg/sq.cm) obtained with control strip $C_1'$ is presented in FIG. 2 as curve $C_1'$, the curve obtained with control strip $C_1''$ in FIG. 3 as curve $C_1''$, and the curve obtained with control strip $C_1'''$ in FIG. 4 as curve $C_1'''$.

EXAMPLE 7

Recording material G according to the present invention.

The preparation of recording material G was the same as that described for material D except for the use of 1 g of acid-sensitive reducing agent precursor 4 of Table 1 instead of 1.6 g of said compound 9.

The coating was effected at 2 g per sq.m of said organo-tellurium compound.

The drying and exposure proceeded as described in example 3. The development was performed by overall heating the exposed material G at 160° C. for 5 min.

The obtained density (D) versus erg/sq.cm curve of material G is presented in FIG. 4 as curve G.

EXAMPLE 8

Recording material H according to the present invention.

The preparation of recording material H was the same as that described for material D except for the use of 1.1 g of acid-sensitive reducing agent precursor 5 of table 1 instead of 1.6 g of said compound 9. The coating was effected at 2 g per sq.m of said organo-tellurium compound.

The drying and exposure proceeded as described in example 3. The development was performed by overall heating the exposed material H at 160° C. for 5 min.

The obtained density (D) versus erg/sq.cm curve of material H is presented in FIG. 4 as curve H.

EXAMPLE 9

Recording material J according to the present invention.

The preparation of recording material J was the same as that described for material D except for the use of 0.8 g of acid-sensitive reducing agent precursor 6 of table 1 instead of 1.6 g of said compound 9.

The coating was effected at 2 g per sq.m of said organo-tellurium compound.

The drying and exposure proceeded as described in example 3. The development was performed by overall heating the exposed material J at 160° C. for 5 min.

The obtained density (D) versus erg/sq.cm curve of material J is presented in FIG. 4 as curve J.

We claim:

1. A photosensitive recording material containing in admixture in a binder medium:
   1. as imaging substance an organo-tellurium compound containing directly linked to a tellurium atom halogen and at least one organic substituent comprising at least one carbonyl group,
   2. a photoreductant which upon exposure to activating radiation in the presence of a hydrogen-donating compound reduces said organo-tellurium compound to liberate metallic tellurium and halogen acid,
   3. a hydrogen-donating compound from which hydrogen can be abstracted by the photo-exposed photoreductant, and
   4. an organic reducing agent precursor, from which by the action of an acid a compound capable of reducing said organo-tellurium compound can be set free and which satisfies the assessment tests A and B as described in the specification.

2. A material according to claim 1, wherein the organo-tellurium compound corresponds to the following general formula:

$$R_xTeCl_y$$

wherein:

R represents an organic group which by a carbon atom is linked to the tellurium atom and contains at least one carbonyl group, x is 1, 2 or 3 and x+y is 4.

3. A material according to claim 2, wherein the organo-tellurium compound corresponds to the following general formula:

$$(Ar—CO—CH_2)_2TeCl_2$$

wherein:

Ar stands for an aromatic group including a substituted aromatic group.

4. A material according to claim 3, wherein the organo-tellurium compound is bis(phenacyl)-tellurium dichloride.

5. A material according to claim 1, wherein the photoreductant is an aromatic diketone.

6. A material according to claim 5, wherein the aromatic diketone is 9,10-phenanthrenequinone or 2-t-butylanthraquinone.

7. A material according to claim 1, wherein the hydrogen-donating compound has a hydrogen atom bonded to a carbon atom, to which the oxygen atom of a hydroxyl group or the trivalent nitrogen atom of an amine substituent are also bonded.

8. A material according to claim 7, wherein the hydrogen-donating compound corresponds to the following general formula:

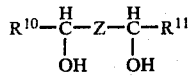

wherein:

each of $R^{10}$ and $R^{11}$, which may be the same or different, represents hydrogen, a hydrocarbon group including a straight chain, branched chain and cyclic hydrocarbon group, or an alkoxycarbonyl group, Z represents a single bond, an ethynylene group

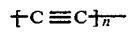

or the group

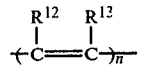

wherein n represents a whole number, and each of $R^{12}$ and $R^{13}$, which may be the same or different, represents hydrogen, or an alkyl group or together form part of a carbocyclic or heterocyclic ring.

9. A material according to claim 8, wherein the hydrogen-donating compound is phenyl-1,2-ethane diol.

10. A material according to claim 1, wherein the organic reducing agent precursor is a para- or ortho-dihydroxyaryl compound at least one of whose hydroxyl groups has been esterified and whose remaining hydroxyl group (if any) may have been etherified.

11. A material according to claim 1, wherein the organic reducing agent precursor is derived from a pyrazolidin-3-one reductor, in which the active hydrogen atom in the 2-position is temporarily blocked by reaction with an isocyanate or with an acid halide.

12. A recording process comprising the steps of (a) information-wise exposing a photosensitive recording material containing in admixture in a binder medium:
   (1) as imaging substance an organo-tellurium compound containing directly linked to a tellurium atom halogen and at least one organic substituent comprising at least one carbonyl group,
   (2) a photoreductant which upon exposure to activating radiation in the presence of a hydrogen-donating compound reduces said organo-tellurium compound to liberate metallic tellurium and halogen acid,
   (3) a hydrogen-donating compound from which hydrogen can be abstracted by the photo-exposed photoreductant, and
   (4) an organic reducing agent precursor, from which by the action of an acid a compound capable of reducing said organo-tellurium compound can be set free and which satisfies the assessment tests A and B as described in the specification, the exposure being effected with electromagnetic radiation to which the photoreductant is sensitive, and (b) overall heating the exposed material to develop a tellurium metal image in the photo-exposed areas.

13. A recording process according to claim 12, wherein the overall heating proceeds in the temperature range of 80° C. to 200° C.

* * * * *